United States Patent [19]

Bodily

[11] 4,270,772

[45] Jun. 2, 1981

[54] ADJUSTABLE BIORHYTHM DISPLAY ASSEMBLY

[76] Inventor: Errol G. Bodily, 9789 Sandridge Dr., Sandy, Utah 84070

[21] Appl. No.: 60,983

[22] Filed: Jul. 26, 1979

[51] Int. Cl.[3] ..... B42D 15/00; G06C 3/00

[52] U.S. Cl. ..... 283/1 A; 235/88 RC

[58] Field of Search ..... 283/1 A; 40/359, 107 B; 235/78 R, 78 RC, 79, 88, 89, 70 A, 85 R, 85 FC

[56] References Cited

U.S. PATENT DOCUMENTS

| | | | |
|---|---|---|---|
| 3,253,780 | 5/1966 | Stewart | 235/88 X |
| 4,035,616 | 7/1977 | Piringer | 40/107 B |

FOREIGN PATENT DOCUMENTS

| | | | |
|---|---|---|---|
| 545605 | 9/1957 | Canada | 235/85 FC |
| 339758 | 9/1959 | Switzerland | 235/89 R |
| 696339 | 8/1953 | United Kingdom | 40/359 |

*Primary Examiner*—Paul A. Bell
*Assistant Examiner*—John S. Brown
*Attorney, Agent, or Firm*—Trask & Britt

[57] ABSTRACT

An assembly for displaying several biorhythms of an individual in graphical format includes a graph background organized as a calendar and a set of transparent overlays. Each overlay is printed with a sine wave of periodicity corresponding to a specific biorhythm cycle. The overlays are positioned against the background to effect an individually adjusted graphical representation of the biorhythms of that individual plotted against specific dates.

8 Claims, 3 Drawing Figures

ADJUSTABLE BIORHYTHM DISPLAY ASSEMBLY

BACKGROUND OF THE INVENTION

1. Field:

This invention relates to biorhythms and provides an improved assembly for displaying the biorhythms of an individual for specific dates within a long period of time.

2. State of the Art:

The theory of biorhythms has developed over the course of many years. As presently understood, the more important biorhythms of interest to human performance are: the 23 day physical cycle, governing fluctuations in body function, such as strength, endurance, coordination and resistance to disease; the 28 day emotional cycle, influencing sensitivity, creativity and perception, as reflected in mood and mental health; and the 33 day intellectual cycle, regulating alertness, memory, and logical and analytical mental functions. According to the theory of biorhythms, these three life rhythms begin in unison from a neutral state at the moment of birth, rise to respective maximums, decrease through the neutral state to minimums, and thereafter fluctuate in a generally sinusoidal pattern according to their respective periodicities, throughout a lifetime.

Various approaches have been suggested for calculating and displaying the "values" of an individual's biorhythms at any particular date following birth. Such calculations are somewhat complexified by the existence of leap years, by the fact that the periodicity of each biorhythm cycle is different, and by the fact that the number of days in any year is not conveniently divided by the number of days in any of the respective biorhythm cycles of interest. More than ordinary mathematical comprehension and skill is required to perform the necessary calculations. Accordingly, for most individuals to inform themselves concerning their personal data pertinent to each of the biorhythms of interest, it is necessary to resort to rather elaborate tables. These tables contain calculations based upon birth dates, and function to locate the position of selected biorhythms within their respective cycles on selected dates following a selected birth date.

Several of the procedures known to the prior art result in a set of values descriptive of the location of a particular biorhythm function for a specific day only. For example, a set of values: −3, +5, +7 might indicate that an individual has biorhythms 30% below neutral in the physical cycle, 50% above neutral in the emotional cycle and 70% above neutral in the intellectual cycle on the day of interest. Other procedures permit the calculation of a number of sets of data from which may be plotted a sinusoidal graph over an increment of time, typically a week or a month. Whether these procedures are embodied for manual or mechanical (e.g., computerized) renderings, the result is similar. That is, the information obtained as a consequence of an elaborate procedure is relevant to a single day. Alternatively, a fairly lengthy procedure is required to adduce and display information pertinent to a relatively short period of time. There exists a need for a procedure which can quickly determine biorhythm data pertinent to an individual and to present that data in a graphical format whereby a plurality of biorhythms are plotted against a lengthy interval between widely separated dates.

SUMMARY OF THE INVENTION

The principals of this invention are applicable to long range displays of biorhythms of various sorts. It is recognized that many biorhythm functions in addition to the three of current popular interest exist, and that a display format including such biorhythms may be of interest. Nevertheless, for convenience and simplicity of explanation, this disclosure is directed towards the three human biorhythms of popular concern; physical, emotional and intellectual. Moreover, while it is recognized that the biorhythm cycles of various individuals may in fact deviate somewhat from theoretical, it is conventional practice to assign periodicities to the aforementioned functions of 23, 28 and 33 days, respectively. The experience within the art is that these periodicities are sufficiently accurate for general use. Accordingly, the present disclosure adopts them. It is recognized, however, that the present invention may be adapted to display any number of biorhythms and that the periodicity of any given biorhythm is merely incidental to the procedures of the invention.

As used herein and in the appended claims, the term "sine function" or "sine wave" is used in its classical mathematical context to mean a curve defining the locus of points representing the ratio of the length of the side opposite an angle of a right triangle to the hypotenuse of that triangle as the angle is changed from zero through 360°. A sine wave so generated initially has a value of zero, but increases to a maximum at 90°, decreases through zero at 180° to its minimum value (the negative equivalent value of the maximum) at 270°, and returns to a value of zero at 360°. The segment of a sine wave so constructed through the range 0° through 360° is regarded as a single cycle. This cycle can be repeated indefinitely as the angle is increased through multiples of 360°.

Within the context of the present invention biorhythm values change in cycles corresponding to sine waves. The sine wave cycle of a biorhythm is applied to periodicities expressed in days rather than degrees. For example, the physical biorhythm is plotted with a periodicity of 23 days so that its graphical sine wave representation proceeds through an entire cycle during that period. The periodicity of the sine wave corresponding to the emotional biorhythm is 28 days, and the periodicity of the sine wave corresponding to the intellectual biorhythm is 33 days.

In all cases, a neutral reference line connects the biorhythm values corresponding to the 0°, 180° and 360° positions of a sine wave. Thus, the neutral reference line connects the values corresponding to the first, middle and last days of each of the periods of each respective biorhythm sine wave. These values are referred to as "neutral". The amplitude of each biorhythm cycle corresponds to the sine wave values found at 90° and 270°. The value at the 90° position (the day one-fourth of the way through a biorhythm cycle) is regarded as the maximum positive value (maxima), while the value corresponding to 270° (the day three-fourths of the way through a biorhythm cycle) is regarded as the minimum negative value (minima). The positive phase of each biorhythm cycle is that portion of its sine wave representation plotted above the neutral reference line, whereas the negative phase of the biorhythm is the portion of the sine wave plotted below the neutral reference line.

A biorhythm is said to move from a negative to a positive value when its sine wave plot moves from below to above the neutral reference line. It is said to move from a positive to a negative value when its sine wave plot moves from above the neutral reference line to below the neutral reference line. In general, the value of a biorhythm plot at the neutral reference line is regarded as zero, while its value at its maxima is regarded as 100% and its value at its minima is regarded as −100%. Other philosophical approaches to biorhythms may be advanced, but within the context of this disclosure the philosophy of biorhythms is of secondary importance. This invention provides a superior assembly and method by which biorhythm values derived according to the theory of biorhythms are displayed in a meaningful manner.

The present invention provides a method and apparatus by which a plurality of biorhythms may be visually displayed for any individual pertinent to an extended time interval; for example, a full year.

A typical embodiment of the invention includes a folder or cover with two leaves divided by a fold line. A window is provided in one (the front) leaf, through which the inside surface of the opposite (the back) leaf is visible. The visible portion of the inside surface of the back leaf is printed with a graphing background format including a visible horizontal reference line and vertical reference lines (usually visible) intersecting the horizontal reference line. Either the intersection or the spaces between intersections correspond to individual days. These days may be assigned specific dates. An entire year may be represented in graphical format with the horizontal reference line corresponding to the abscissa and the vertical lines parallel the ordinate of coordinate axes. It would be possible to follow the procedures well known to the prior art to derive data for several days from which to plot the biorhythm cycles of an individual on the graphing background of this invention. To do so, however, would be laborious and time consuming, and would limit the usefulness of the display to a single individual's cycle during a specified period. An important aspect of the present invention is its adaptability to display, in turn, the biorhythms of a plurality of selected individuals for any selected year, past, present or future (or any other time interval of interest, depending upon the specific construction of the apparatus).

The present invention provides flexibility and adaptability through the use of transparent overlays, each of which is imprinted with an opaque sine wave with a periodicity selected on the basis of a single biorhythm function of interest. Ordinarily, three overlays are used, imprinted with sine waves of periodicities corresponding to the physical, intellectual and emotional cycles, respectively. Ordinarily, each sine wave will be rendered in its own unique color so that it may readily be distinguished from the others. The sine waves are positioned on the overlays so that when the overlays are inserted between the leaves of the folder, the sine waves all register with the horizontal (neutral) reference line at precisely their midpoints. That is, the neutral reference line bifurcates each sine wave into positive and negative phases equal in area. Although it is not strictly required, it is generally more pleasing and avoids confusion if the amplitudes of the several sine waves are equal.

For a sine wave to properly chart a biorhythm of an individual it is necessary to first assign specific dates to the abscissa positions along the neutral reference line. This assignment is easily done by designating a specific date; for example, Jan. 1, 1980, to the first such vertical reference line (or an adjacent space). It is then necessary to locate the sine wave plot so that its intersections, as it travels from the negative to the positive phase, occurs at abscissa locations corresponding to an integral number of cycles after the birth date of the individual. Properly positioning one such intersection automatically positions all such intersections properly. For example, assuming a physical biorhythm cycle of 23 days, the sine wave corresponding to the physical biorhythm is positioned with respect to the graphing background so that it intersects the neutral reference line as it travels from negative to positive at an abscissa location corresponding to a date which occurs a total number of days elapsed from the moment of birth divisible by 23. Proper intersection points are determined for each of the other biorhythms of interest in the same fashion. That is, the classical emotional intersection point will occur at a date a total number of days elapsed from birth divisible by 28, and the classical intellectual intersection point will occur at a date which is a number of days elapsed from the date of birth divisible by 33.

From the foregoing, it will be apparent that there are 23 possible abscissa positions for the physical biorhythm overlay, 28 for the emotional overlay, and 33 for the intellectual overlay. For convenience, the graphing background may be marked with code symbols corresponding to the abscissa positions appropriate for each of the three overlays. Indicators on each overlay may be cooperatively adapted to register with the symbols. In this way, by determining the appropriate symbols for a specific year, as derived from a selected birth date, the overlays may be speedily positioned to display an individual's biorhythm chart by bringing the indicators of the overlays into proper registration with the symbols. Code symbols appropriate for any combination of birth date and display interval may be precalculated and tabulated for any selected periodicity.

A single printed graphing background may be used for displaying the biorhythms of any individual for any selected year. Given a birth date, it is merely required to determine the appropriate reference symbols for the display year of interest. The display for leap years will require an adjustment on Feb. 29th. On that day, all of the overlays should be moved to locations corresponding to one day earlier (assuming that the format contains 365 abscissa locations rather than 366).

A specific embodiment of the invention will be more readily understood by reference to the accompanying drawings and their description. Of course, it will be understood that the invention may be embodied variously. For example, the graphing background may be provided in structure other than the folder shown (e.g., a leaf within a book). The overlays can be registered with the graphing background in various ways.

BRIEF DESCRIPTION OF THE DRAWINGS

In the drawings, which represent what is presently regarded as the best mode for carrying out the invention.

DESCRIPTION OF THE ILLUSTRATED EMBODIMENTS

Figure 1:
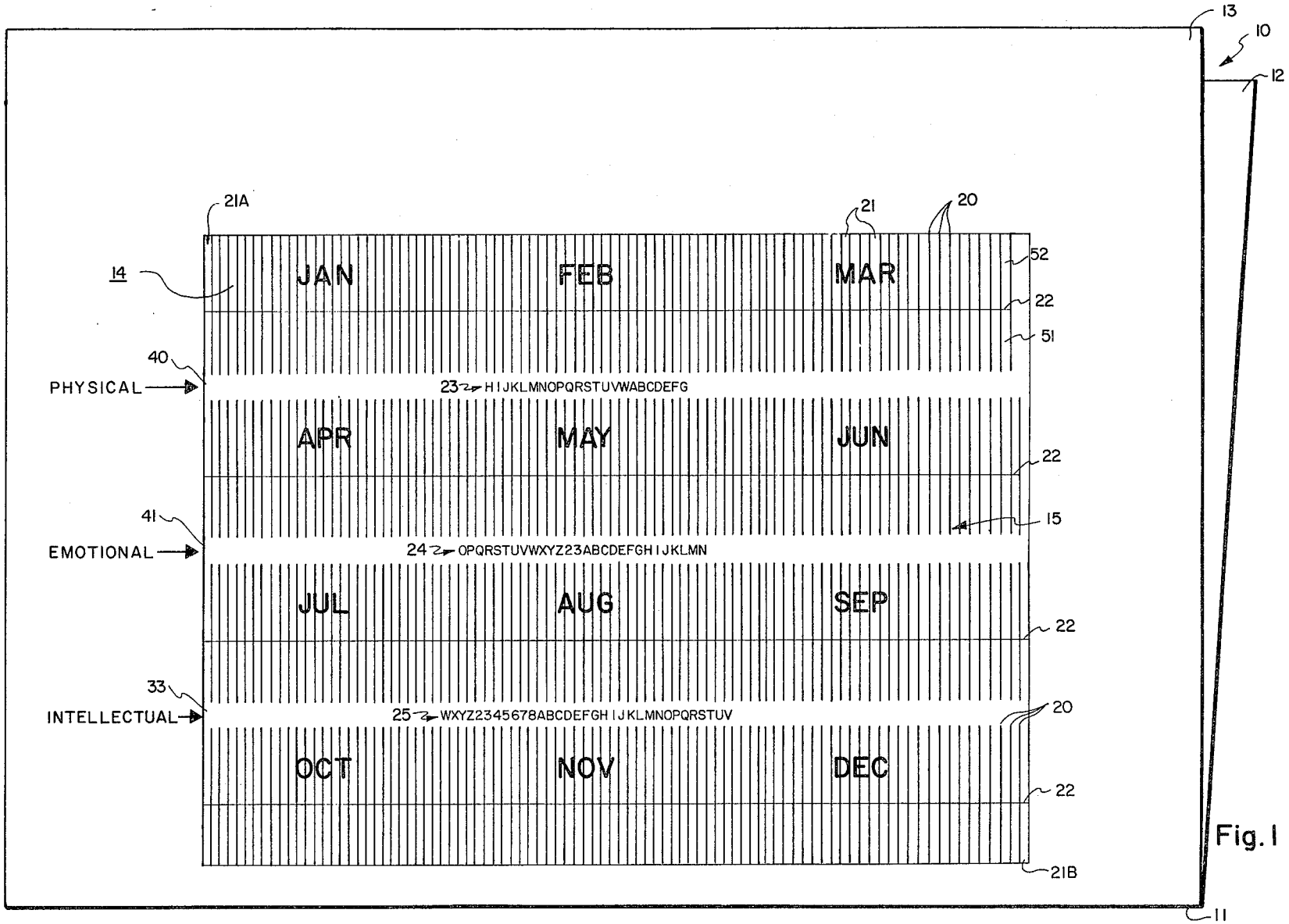
FIG. 1 shows a graphing background format, carried within a cover assembly of this invention.

Referring to FIG. 1, a cover 10 is constructed of heavy cardboard or other suitable material folded along a fold line 11 into a folder having a back leaf 12 and a front leaf 13. A window 14 is provided in the front leaf 13 so that the interior surface of the back leaf 12 is visible. A graphing grid background 15 is printed on the interior surface of the back leaf 12, as shown. In the illustrated instance, the graphing background is presented in a format corresponding to the four calendar quarters of an entire year. A series of vertical reference lines 20 define abscissa intervals 21 corresponding to the days of a year. The first such interval 21A corresponds to Jan. 1, and the last such interval 21B corresponds to Dec. 31. The display format illustrated may be used without any adjustment for any year except leap years. Leap years require an adjustment on Feb. 29 as referred to earlier in this disclosure.

The vertical reference lines 20 each intersect a horizontal neutral reference line 22 corresponding to the neutral biorhythm level, that is the biorhythm level at the instant of birth.

Associated with the printed graphing background 15 are three sets 23, 24, 25, respectively, of symbols. The first such set 23 includes 23 individual symbols corresponding to the 23 days within the physical biorhythm cycle. The second set 24 includes 28 symbols corresponding to the 28 days within the emotional biorhythm cycle, and the third set 25 includes 33 symbols corresponding to the 33 days within the intellectual biorhythm cycle. The symbols are spaced horizontally from each other in precisely the same spacing as adjacent vertical lines 20. The biorhythm function with which each group of symbols is identified is indicated to the left on the face of the front leaf 13 of the folder 10.

Figure 2:
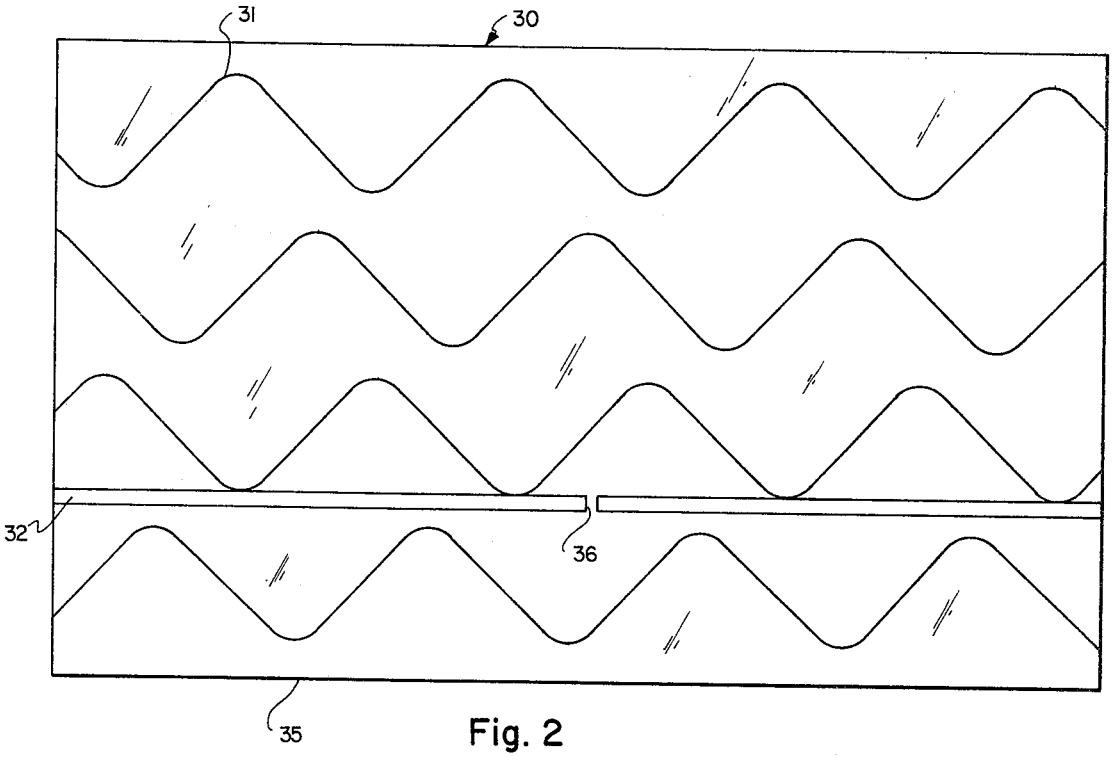
FIG. 2 shows a typical transparent overlay with an intellectual biorhythm sine wave imprinted thereon.
Figure 3:
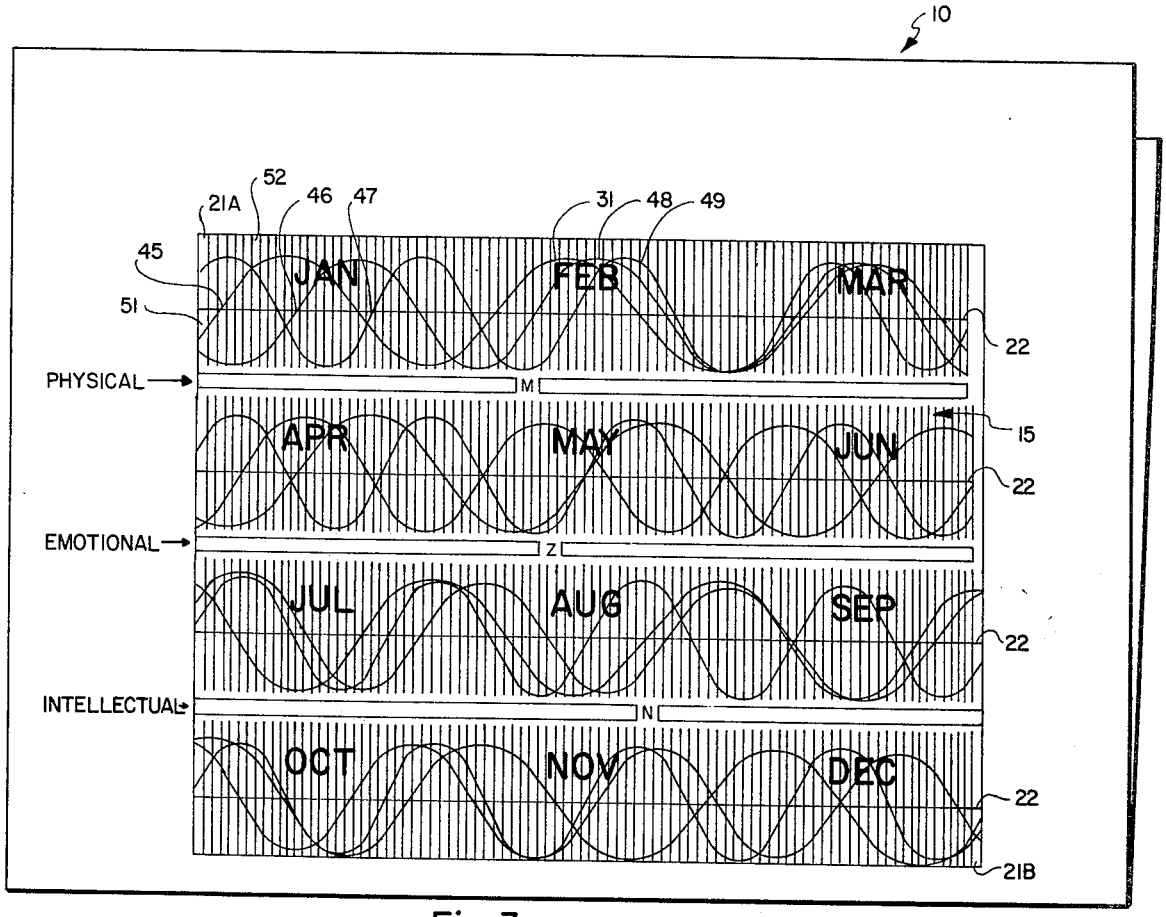
FIG. 3 shows a biorhythm chart assembly of this invention, including a set of three transparent overlays positioned therein.

FIG. 2 shows one of the transparencies 30 used as an overlay for the display surface 15 of FIG. 1. The transparent overlay 30 carries an opaque sine wave 31. In the illustrated instance, the sine wave has a periodicity of 33 and is used to display the intellectual biorhythm cycle. An indicator strip 32 is positioned to register with a corresponding code strip 33 of the graphing background 15. The specific code strip 33 includes the set 25 of 33 code symbols appropriate for the intellectual biorhythm. When the overlay is positioned between the leaves 12, 13 of the cover 10 as shown by FIG. 3, the bottom edge 35 of the overlay 30 rests upon the fold 11, thereby assuring proper registration of the indicator strip 32 with the code strip 33. A gap 36 in the strip 32 may be positioned to display any selected of the code symbols 25. In this way, the horizontal (abscissa) positioning of the overlay 30 may be selected from any of 33 locations represented by the intellectual set of symbols 25.

Overlays for the physical and emotional cycles are similar to the overlay 30 for the intellectual cycle, except that their periodicities are 23 and 28 days, respectively. The indicator strips for the physical and emotional cycles will be located on their respective overlays to register with the code strips 40 and 41, respectively.

FIG. 3 shows the three overlays positioned within the folder 10 with each overlay registered with an appropriate symbol to display the three biorhythm cycles for a selected individual as they will be experienced during a selected calender year. Ideally, the sine waves and indicator strip of each overlay are color coded to identify them with a specific biorhythm; e.g., red (physical), blue (emotional), and green (intellectual).

Selection of the code symbols M, Z and N illustrated by FIG. 3 is accomplished in accordance with established biorhythm theory, Such symbols are referred to within the art as charting codes. These symbols locate the interception points 45, 46 and 47 of the sine waves 31, 48 and 49, respectively, with the neutral reference line 22 as they move from the negative region 51 to the positive region 52 of the graphing background 15. As shown, the sine wave 31 of longest periodicity, the intellectual wave, intersects the neutral reference line 22 at a location 45 corresponding with January 2nd. Accordingly, it can be deduced that the number of days between birth and January 2nd of the year being displayed is divisible without remainder by 33. Similarly, the number of days between birth and Jan. 11 (intersection 46) of the display year is divisible without remainder by 28, the number of days in the emotional biorhythm cycle.

The specific symbols used for charting codes are arbitrary, but once selected they may readily be tabulated for any display year from rigorous calculations based upon the historical calender, the known periodicities of the cycles of interest, and the birth date of interest. A tabulation directly useful with the illustrated embodiment is published by Tempus, Inc. of Salt Lake City, Utah, in the booklet "Lifetime Biorhythm", Edward Burghardt, 1979. The disclosure of that booklet is incorporated herein by reference.

Reference herein to details of the illustrated embodiment is not intended to limit the scope of the appended claims, which themselves recite those details regarded as essential to the invention.

I claim:

1. An adjustable biorhythm display assembly, comprising:

a graphing background presenting a neutral reference line in association with indicia spaced along said reference line at abscissa locations in correspondence to the days within an interval of time;

a set of transparent overlays, each imprinted with a visible sine wave with a selected periodicity corresponding to a number of said indicia equal to the number of days included within a significant human biorhythm cycle positionable over said background format so that each period of each said sine wave begins and ends on said neutral reference line;

means for holding said set of overlays in association with said background format so that all of said sine waves are visible against said reference line with each intersecting said reference line from negative to positive at abscissa locations selected an integral number of its periods counted from a preselected date of birth; including a cover folded into a front leaf and a back leaf, wherein the inside surface of said back leaf is printed with said graphing background and said front leaf includes a window through which said graphing background is visible, said overlays being positionable between said leaves.

2. An adjustable biorhythm display assembly according to claim 1 wherein said set of transparent overlays includes:

a first overlay carrying a first said sine wave with a periodicity corresponding to the number of days within the human physical biorhythm cycle;

a second overlay carrying a second said sine wave corresponding to the number of days within the human emotional biorhythm cycle; and a third overlay carrying a third said sine wave corresponding to the number of days within the human intellectual biorhythm cycle.

3. An adjustable biorhythm display assembly according to claim 2 wherein the periodicities of said sine waves are 23, 28 and 33 days, respectively.

4. An adjustable biorhythm display assembly according to claim 1 in combination with means for determining the appropriate abscissa locations of the intersections of each said sine wave with said reference line to display the biorhythm cycles of a particular individual for a selected display year, said means including means for extrapolating from the date of birth of said individual, based upon the respective periodicities of said sine waves, to said selected year, thereby to determine the intersection points of each said wave with said reference line, each said intersection, as the wave proceeds from below to above the reference line, corresponding to an integral number of periods of that wave from said date of birth until the dates represented by said intersections in said selected year.

5. An assembly according to claim 4 wherein said graphing background includes a plurality of rows of code symbols, the symbols in each row corresponding to the number of days included within the period of the sine wave carried by a selected said overlay and correlated in position to said abscissa locations spaced along said reference line; each said selected overlay carries indicator means to register with the symbols of that row; and the symbols and indicator means are cooperatively adapted to position said intersections in accordance with said extrapolation.

6. An assembly according to claim 5 wherein the sine wave and indicator carried by each said overlay are color coded to their unique biorhythm.

7. An assembly according to claim 1 wherein said graphing background and said overlays carry means cooperatively adapted to position visually said sine waves to intersect said neutral reference line at said selected abscissa locations.

8. An assembly according to claim 7 wherein said background includes separate code strips for each overlay with symbols corresponding to each day within the period of the sine wave carried by said overlay, and each overlay includes an opaque indicator strip with a gap adapted to register with a selected said symbol.

* * * * *